US007178554B2

(12) United States Patent
Tanner et al.

(10) Patent No.: US 7,178,554 B2
(45) Date of Patent: Feb. 20, 2007

(54) ULTRASONICALLY CONTROLLED VALVE

(75) Inventors: James Jay Tanner, Athens, GA (US); Robert A. Cool, Alpharetta, GA (US); Thomas D. Ehlert, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 11/139,928

(22) Filed: May 27, 2005

(65) Prior Publication Data

US 2006/0266426 A1 Nov. 30, 2006

(51) Int. Cl.
*F15C 1/04* (2006.01)

(52) U.S. Cl. ..... 137/828; 137/522; 137/533.11; 137/901; 239/102.1

(58) Field of Classification Search ..... 137/828, 137/522, 533.11, 901; 239/102.1
See application file for complete search history.

(56) References Cited

U.S. PATENT DOCUMENTS

| | | | | |
|---|---|---|---|---|
| 1,793,273 | A | 2/1931 | Zerk | |
| 2,107,858 | A | 2/1938 | Foster | |
| 2,728,614 | A | 12/1955 | Rink | |
| 3,109,398 | A | 11/1963 | Abramowicz | |
| 3,243,122 | A * | 3/1966 | Snaper | 239/102.2 |
| 3,586,130 | A | 6/1971 | McCafferty, Jr. et al. | |
| 3,741,344 | A | 6/1973 | Kohl et al. | |
| 3,949,938 | A * | 4/1976 | Goodinge | 239/102.2 |
| 3,981,480 | A * | 9/1976 | Eernisse et al. | 251/129.06 |
| 4,000,852 | A | 1/1977 | Martin | |
| 4,166,605 | A * | 9/1979 | Hall et al. | 251/129.06 |
| 4,307,838 | A | 12/1981 | Martin | |
| 4,428,531 | A | 1/1984 | Martin | |
| 5,803,106 | A | 9/1998 | Cohen et al. | |
| 5,868,153 | A | 2/1999 | Cohen et al. | |
| 6,010,592 | A | 1/2000 | Jameson et al. | |
| 6,036,467 | A | 3/2000 | Jameson | |
| 6,053,424 | A | 4/2000 | Gipson et al. | |
| 6,315,215 | B1 | 11/2001 | Gipson et al. | |
| 6,380,264 | B1 | 4/2002 | Jameson et al. | |
| 6,395,216 | B1 | 5/2002 | Jameson | |
| 6,450,417 | B1 | 9/2002 | Gipson et al. | |
| 6,543,700 | B2 | 4/2003 | Jameson et al. | |
| 6,659,365 | B2 | 12/2003 | Gipson et al. | |
| 6,663,027 | B2 | 12/2003 | Jameson et al. | |
| 6,776,352 | B2 | 8/2004 | Jameson | |

FOREIGN PATENT DOCUMENTS

| | | |
|---|---|---|
| DE | 4418228 | 9/1995 |
| EP | 0057466 | 8/1982 |

OTHER PUBLICATIONS

Patent Abstracts of Japan, JP 60153465, Aug. 12, 1985.
Patent Abstracts of Japan, JP 62094713, May 1, 1987.
Patent Abstracts of Japan, JP 01116276, May 9, 1989.
Patent Abstracts of Japan, JP 03094855, Apr. 19, 1991.

* cited by examiner

*Primary Examiner*—A. Michael Chambers
(74) *Attorney, Agent, or Firm*—Scott B. Garrison

(57) ABSTRACT

An ultrasonically operated valve a source of ultrasonic energy for excitation of a pressurized liquid. The vibration of the ultrasonic horn imparts a pulsing of the pressure of the liquid within the valve. Selection of a sealing mechanism that responds at a different natural frequency than that of the valve body causes the sealing mechanism to unseat and therefore to enable liquid flow. The sealing mechanism will stay unseated as long as the source is imparting energy to the system and therefore inducing pressure pulses in the liquid thus keeping the sealing mechanism away from the valve seat.

15 Claims, 3 Drawing Sheets

ULTRASONICALLY CONTROLLED VALVE

BACKGROUND OF THE INVENTION

The present invention relates to a valve and, more particularly, to an ultrasonically controlled valve mechanism.

A number of early patents teach the use of adapting machine vibration to open a port enabling unpressurized lubrication to flow out of a port or to activate an inertial pump having a frequency different from the vibration of the machinery. Specifically, U.S. Pat. No. 1,793,273 to Zerk; U.S. Pat. No. 2,107,858 to Foster; U.S. Pat. No. 2,728,614 to Rink; U.S. Pat. No. 3,109,398 to Abramowicz; U.S. Pat. No. 3,586,130 to McCafferty, Jr. et al.; and U.S. Pat. No. 3,741,344 to Kohl et al. disclose various designs to lubricate some component. Each of these designs relies upon gravity to create a restorative force or inertial force in order to operate the machinery.

What is needed is mechanism that can be oriented in any direction and does not require gravitational influence to function.

SUMMARY OF THE INVENTION

In response to the foregoing problems and difficulties encountered by those of skill in the art, the present invention is directed toward an ultrasonically operated valve having a valve body which in turn has an inlet, an outlet, a passage in communication with the inlet and outlet, and a valve seat proximal to the outlet. A valve sealing mechanism is disposed within the passage and is adapted to be received by the valve seat. The valve sealing mechanism seals the passage from an external environment upon introduction of a pressurized liquid into the passage. A source of ultrasonic energy for excitation of the pressurized liquid is provided as well.

The source of energy is used for creating an unbalance force on the valve sealing mechanism and hence moving it away from the valve seat thereby enabling liquid to exit the passage through the outlet. The valve body and the valve sealing mechanism and liquid are selected so that they acoustically resonate at different frequencies and transmit acoustic energy pulses at different rates. The material properties of the valve sealing mechanism could be selected such that ultrasonic energy from the source is acoustically transmitted through the valve sealing mechanism more rapidly than the energy is transmitted through the pressurized liquid. In certain embodiments the valve sealing mechanism, the valve seat, or both may contain a resilient surface coating. In other embodiments, the valve sealing mechanism may consist of at least two discrete materials.

In some embodiments, the source of ultrasonic energy may be at least partially contained within the passage. The source of ultrasonic energy may also consist of a tip which would correspond to an antinode (i.e., point of maximum axial movement and no radial movement) of the source of ultrasonic energy. The tip would be spaced a distance from the valve sealing mechanism.

In another embodiment, a valve for controlling the flow of a pressurized liquid is provided. The valve would consist of a valve seat, a sealing mechanism interacting with the valve seat, a resonant body, an ultrasonic energy source coupled to the resonant body, and a pressurized liquid. The pressurized liquid serves to seat the sealing mechanism against the valve seat, preventing flow of the pressurized liquid. The ultrasonic energy source vibrates the resonant body unseating the sealing mechanism from the seat, enabling flow of the pressurized liquid.

In this embodiment, the resonant body may consist of a tip located at an antinodal plane of the resonant body. The tip would be directed at the sealing mechanism and upon activation of the ultrasonic energy source would impart acoustical energy into both the pressurized liquid and the sealing mechanism creating an unbalanced pressure pulse on the sealing mechanism. In any event, such a valve may have a liquid inlet and a liquid outlet. At least one of these may be stationary and nonmoving with respect to an environment external to the valve.

In many of the embodiments, the valve seat and sealing mechanism may be situated within an internal passage provided in the resonant body. The internal passage may have an inlet and an outlet, wherein activation of the ultrasonic energy source sets up pressure pulses in the liquid contained within the resonant body unseating the sealing mechanism from the seat. This would enable flow of the pressurized liquid from the inlet, through the internal passage, ultimately to exit the valve via the outlet.

Other objects, advantages and applications of the present invention will be made clear by the following detailed description of a preferred embodiment of the invention and the accompanying drawings wherein reference numerals refer to like or equivalent structures.

DETAILED DESCRIPTION OF THE INVENTION

Figure 1:
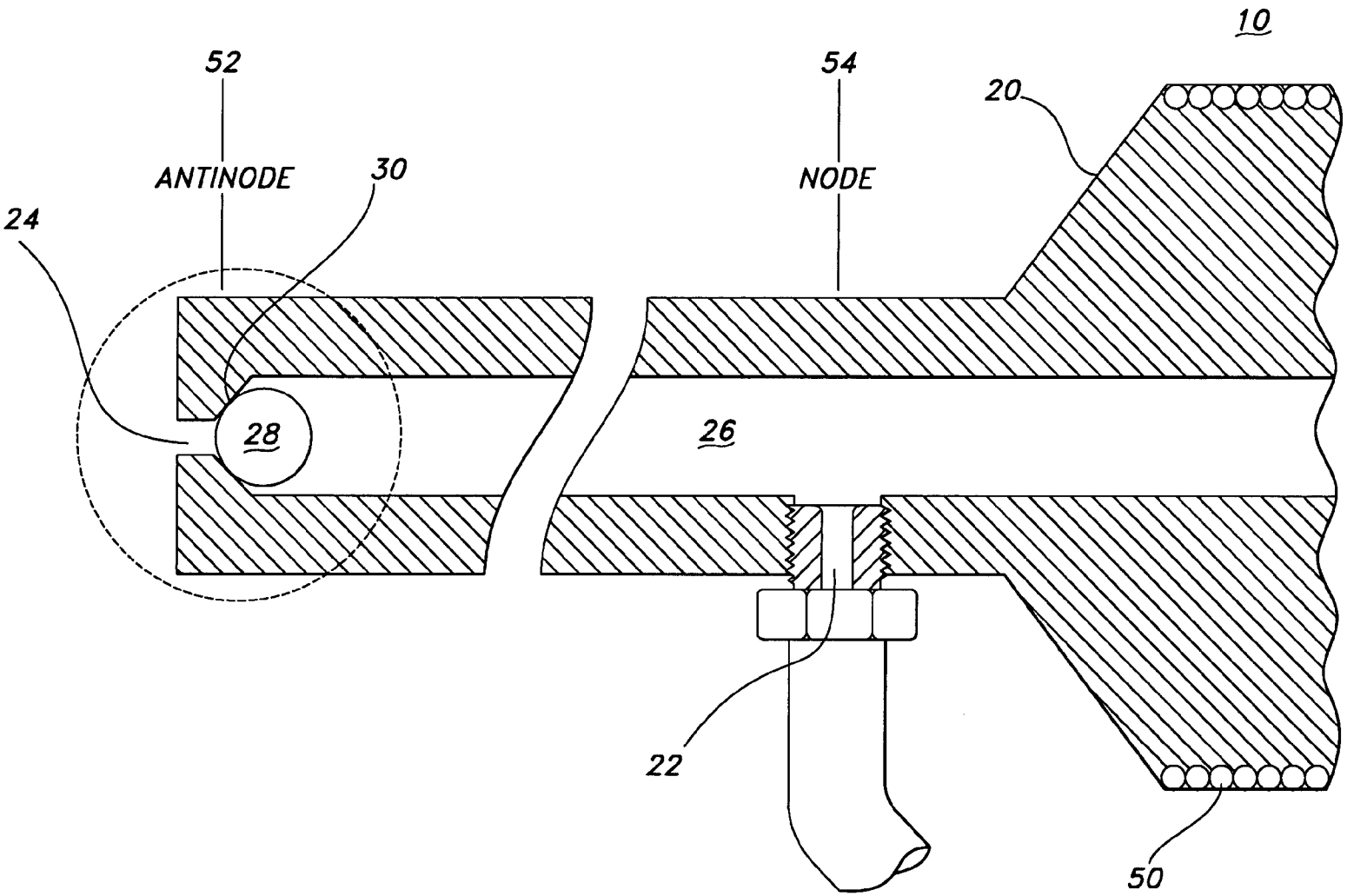
FIG. 1 is a cutaway of a side elevation of an embodiment of the ultrasonically controlled valve mechanism according to the present invention.

In response to the foregoing challenges that have been experienced by those of skill in the art, the present invention is directed toward an ultrasonically controlled valve 10 as depicted in FIG. 1. The FIG. 1 embodiment of valve 10 includes a valve body 20 having an inlet 22 and an outlet 24 connected by a passage 26. The valve 10 is constructed such that it is capable of passing a pressurized liquid therethrough. The term "a pressurized liquid" refers to a liquid that is at a higher pressure than the surrounding environment within which the liquid is discharged and as such is a relative term.

Situated within the passage 26 is a sealing mechanism 28. In the present embodiment, the sealing mechanism may be configured into the shape of a ball or sphere as shown. However, other plug configurations, such as conical, elliptical, cylindrical, tapered, as well as others are possible as well. Regardless of the specific shape, in all cases the sealing mechanism 28 seals the valve 10 against liquid flow. It does this by seating against a valve seat 30. The valve seat 30 may be formed into the passage 26 itself, and as shown may comprise a surface machined into the valve body 20.

Figure 2:
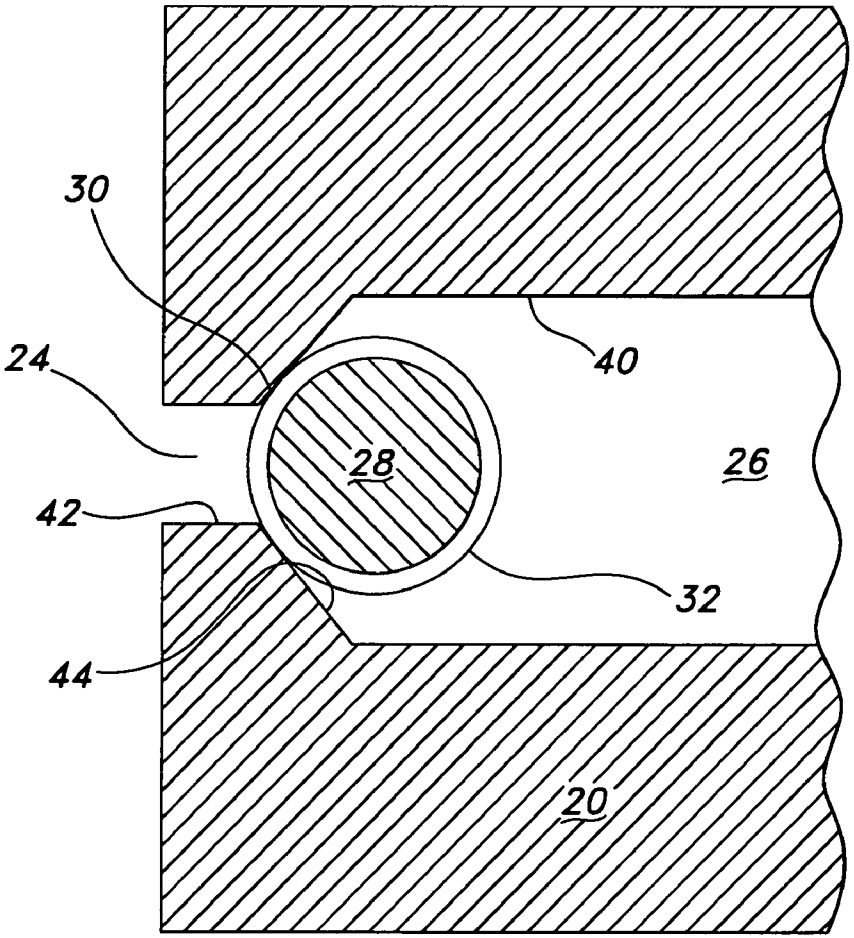
FIG. 2 is an enlarged view of the area in phantom depicted on the FIG. 1 view.

Looking now to FIG. 2, a more detailed view of this area may be had. Specifically, passage 26, in this embodiment, includes a first diametrical region 40 that transitions to a second diametrical region 42. Between these two regions is an area or transition zone 44. At least a portion of the transition zone 44 comprises the seating surface or valve seat 30. In the case of the sealing mechanism 28 being spherical as shown, the valve seat 30 may be provided with a curved surface to match and receive the sealing mechanism 28.

To ensure proper seating, in some embodiments, the valve seat 30, the sealing mechanism 28, or both may be made to be deformable. A number of techniques known to those of skill in the art may be used. As an example, either the sealing mechanism 28, the valve seat 30, or both may comprise a coating 32. The coating 32 may in some instances comprise a plastic, a rubber, or some other resilient and deformable material. As depicted in FIG. 2, the coating 32 may be found on the sealing mechanism 28. However, as stated, a similar coating may be placed on the valve seat 30, or on both the sealing mechanism 28 as well as the valve seat 30. In any event, the coating 32, if present, is intended to ensure that the seating mechanism 28 positively seals against the valve seat 30. As such, the coating 32 may be of minimal thickness so long as it performs the desired function. For example, if the sealing mechanism comprises a sphere having a diameter of $D_b$, then the coating may be of a thickness ranging from about $0.001D_b$ to about $0.1D_b$.

Looking back once again to FIG. 1, it may be seen that an energy source for ultrasonically pulsating the liquid is provided. In this embodiment, a piezoelectric driver 50 is coupled to or otherwise integrated into the valve 10. The piezoelectric driver is carefully mounted to effectively preclude transforming the valve body into an ultrasonic horn. The piezoelectric driver 50 is mounted at a node which precludes axial vibration of the valve body 20 and as such only transmits the radial vibration induced by the piezoelectric driver into the valve body. The radial vibration is mitigated with a non-rigid material such as an O-ring (not shown). The effect that this arrangement has is to preclude transforming the entire valve 10 into a resonant body or an ultrasonic horn, while enabling the acoustical energy to unseat the sealing mechanism 28 from the valve seat 30. Typical ultrasonic frequencies range from about 20 kHz and greater, however, in many embodiments the frequency ranges from about 20 kHz to about 40 kHz. Proper selection of the mounting material from which to manufacture the valve or horn interface components is necessary in order to prevent undesired vibrational response in the system.

This differentiates the present valve system from the old vibrating oilers where mechanical vibration of the valve body imparts motion to the valve closure, e.g., ball, such as described in U.S. Pat. No. 2,728,614 to Rink; U.S. Pat. No. 3,109,398 to Abramowicz; U.S. Pat. No. 3,586,130 to McCafferty, Jr. et al.; and U.S. Pat. No. 3,741,344 to Kohl et al.

Analyzing the conditions in more detail illustrates that introduction of a pressurized liquid into the valve body 20, via the inlet 22, causes the sealing mechanism 28 to be pushed or to seat and thereby seal against the valve seat 30. This effectively prevents liquid flow from exiting the passage 26 via the outlet 24. The vibration of the ultrasonic horn imparts a pulsing of the pressure of the liquid within the valve housing. Selection of a sealing mechanism 28 that responds at a different natural frequency than that of the valve body 20 creates the necessary conditions enabling the valve sealing mechanism 28 to unseat and therefore to function. This enables flow of liquid from the valve 10 via the outlet 24. The sealing mechanism 28 will stay unseated as long as the piezoelectric driver is imparting energy to the system and therefore inducing pressure pulses in the liquid thus keeping the sealing mechanism 28 away from the valve seat 30. Discontinuing the ultrasonic vibration, i.e., turning off the electrical power to the piezoelectric driver stops the liquid pressure pulses and allows the pressure differential between the inside and outside of the valve assembly to move the sealing mechanism 28 to the valve seat 30. As may be seen, if a liquid under pressure is contained within the hollow core or passage 26 of the valve body 20, the valve 10 becomes an electronically controlled on/off valve for liquid flow. The result is a simple valve that can be opened by application of energy to the valve closure and closed by deactivating the energy source.

Since in the embodiment described above, the entire valve body is not allowed to vibrate at the ultrasonic frequency, as such only pressure pulses occur in the liquid which can be transmitted to the valve body. To preclude leakage, it is important to ensure that the inlet 22 and the outlet 24 are able to accommodate some vibrational movement. One configuration which is capable of accommodating such vibrational energy is to place the inlet 22 at a potential node 52 located on the valve body. The potential node 52 is that portion of the valve body where the any vibrational energy is cancelled out and as a result there is no axial deflection in the valve body 20. An alternative would be to place a resilient coupling, hose, or tubing between the liquid supply and the inlet. Such a component would be capable of elastic deformation in order to accommodate any vibrational energy of the valve body. This component is not depicted since those of skill in the art would have an understanding as to the appropriate material selection and configuration of such a coupling, hose, or tubing. An example of such a material includes but is not limited to a rubber or neoprene based material. As soon as the sealing mechanism 28 unseats and the valve opens, any vibration of the valve body 20 should be minimized due to the elimination of any significant axial force being exerted by the liquid pressure pulses. The resonate frequency of the liquid within the valve body is much lower than the resonate frequency of the material of the valve body. This mismatch further precludes axial vibration of the valve body due to the ultrasonic pressure pulses. For any given resonant body, it is well known and understood that the distance between nodes is L, and the distance between any node to the adjacent antinode is L/2, where L is the wave length of the resonate frequency of the device, e.g., steel valve body.

As stated above, the vibrational energy at the antinode 54 is at its maximum amplitude, and as such if the outlet is placed at or near the antinode in many embodiments it will not be attached to another component since it undergoes the maximum deflection to which the valve body is subjected. As such, the embodiment depicted in FIG. 1 is well suited to applications where the outlet 24 is spraying into an environment external or otherwise not affixed to the valve body. For example, this configuration is suitable to replace needle valves or other needle control devices.

An additional advantage that may prove useful in conjunction with its function as a controllable valve is that the discharge may be atomized or vaporized at the outlet via the effects of ultrasonically enhancing liquid flow. As such, liquid flow can be ultrasonically enhanced at the outlet 24 of the valve 20 as disclosed in the following US patent applications and patents owned by the assignee of record of the present application: U.S. Pat. No. 6,776,352; U.S. Pat. No. 6,053,424; U.S. Pat. No. 5,868,153; U.S. Pat. No. 5,803,106; U.S. Pat. No. 6,450,417; U.S. Pat. No. 6,659,365; U.S. Pat. No. 6,543,700; U.S. Pat. No. 6,663,027; U.S. Pat. No. 6,315,215; U.S. Pat. No. 6,010,592; U.S. Pat. No. 6,380,264; U.S. Pat. No. 6,776,352; U.S. Pat. No. 6,036,467; U.S. Pat.

No. 6,395,216. The subject matter of each of these applications and patents is hereby incorporated in its entirety by reference.

In embodiments such as those described above, liquid is rapidly moved around the sealing mechanism by boundary layer effects and at such high pulsing rates that the sealing mechanism appears to be standing still in the opened position during prolonged operation. This continued unseated condition has been recognized as a significant problem for check valves used on pulsating flow (i.e., pulsating pressure). It is commonly referred to a "flutter" or valve failure. The typical remedy prescribed is to apply more and more pressure to force the sealing mechanism to the valve seat such as with a stiffer spring being applied on the ball.

Configuring the apparatus for use in a diesel fuel injector enables the diesel injector to open, enabling flow for about 0.002 seconds. As such there would be approximately 80 cycles of the ultrasonic horn were it to be operating at approximately 40 kHz under an operating pressure in the range from about 10,000 to about 15,000 psi. Likewise, the apparatus adapted for use in a paint sprayer may be open for about 10 seconds while there are about 400,000 cycles of the ultrasonic horn assuming it was to be operated at about 40 kHz under an operating pressure of about 100 to 200 psi. In each case while ultrasonic energy was being applied to the system, the sealing mechanism would effectively appear to remain stationery and, nevertheless, would not seal the sealing mechanism 28 to the valve seat 30 until the energy was removed.

As described, such a device may be used to atomize or vaporize liquids that are ejected from the horn tip or outlet 24. Use of a valve 10 of this form has been of interest because it enables incorporation of a valve component similar to that typically associated with a needle valve which opens and closes an outlet thus enabling a liquid to flow as desired. Operation as well as atomization may be enhanced through the application of ultrasonic excitation of the horn. A control device of this description may be found especially suitable in use in fuel injectors, paint sprayers, and other devices where on/off control as well as ultrasonic enhancement of atomization may be considered advantageous. The present device is substantially more simple in construction than the prior art devices currently on the market capable of performing an analogous function.

Figure 3:
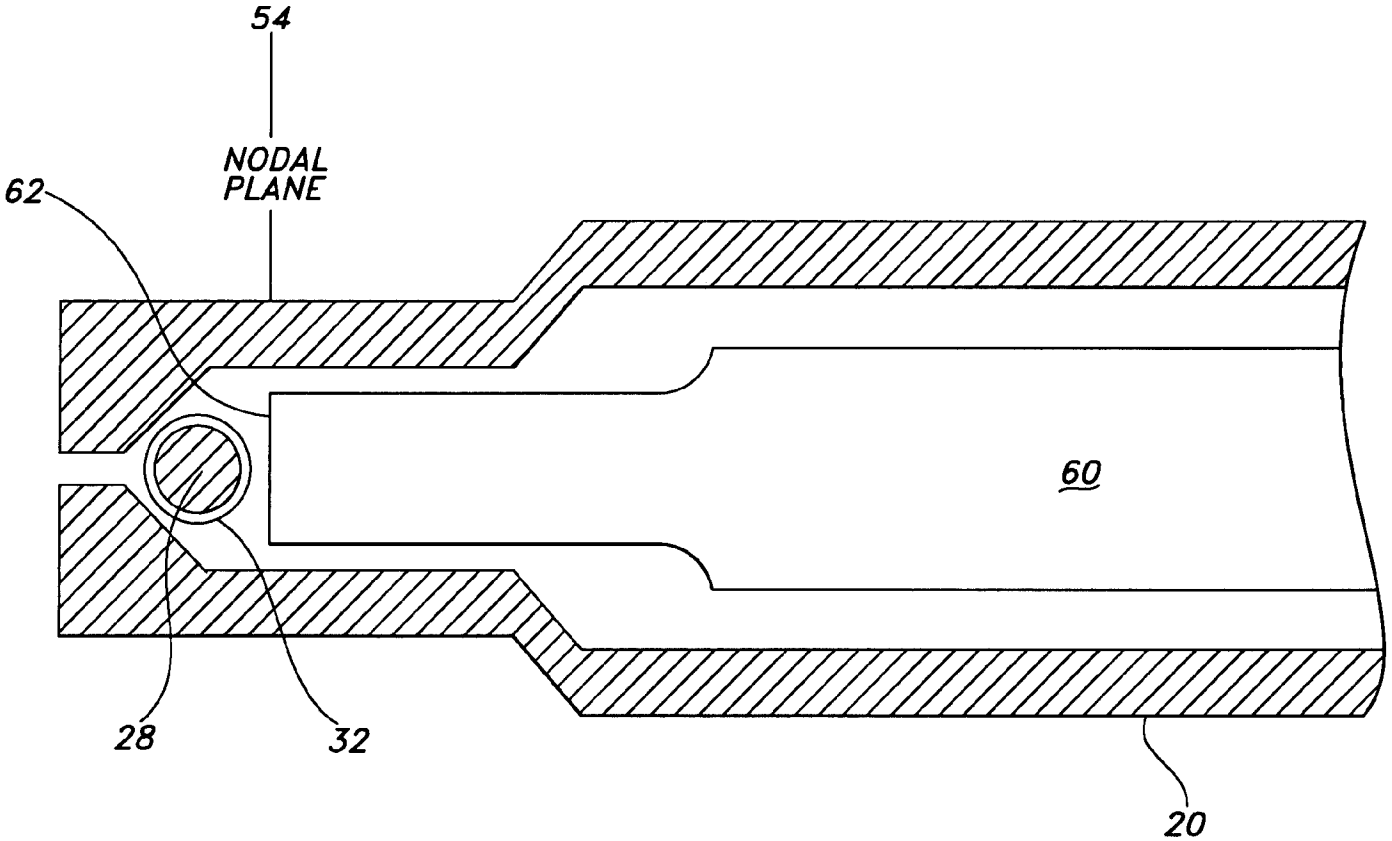
FIG. 3 is a cutaway of a side elevation of an alternative embodiment of the ultrasonically controlled valve mechanism according to the present invention.

In an alternative embodiment, depicted in FIG. 3, a dedicated ultrasonic horn 60 may be provided. Such a horn 60 may be installed within the valve body 20 so that the antinode 54 of the horn 60 comprises a horn tip 62, the horn tip 62 may be placed in close proximity to the sealing mechanism 28. The phrase "in close proximity" refers to a distance of between about 1.5 to 20 diameters of the sealing seat of the valve housing. In some embodiments a nearer distance such as between about 1.5 to 2 diameters from the sealing mechanism 28 may be more useful.

By situating the horn tip 62 in close proximity to the sealing mechanism 28, it is possible to create an unbalanced pressure pulse on the sealing mechanism 28. Due to the properties of acoustical waves, when the pressure wave formed in the liquid by the force pulse created at the horn tip 62 strikes the sealing mechanism 28, it travels faster through the sealing mechanism than that portion of the pressure wave traveling through the surrounding pressurized liquid. Since the energy travels faster through the solid sealing mechanism 28 than the surrounding liquid environment, an unbalanced reaction force is created at the contact area of the valve seat 30 and the sealing mechanism 28. This unbalanced force causes the sealing mechanism 28 to unseat from the valve seat 30. This will occur when the pressure wave travel time and rebound time is less than the time between the next pressure pulse in the liquid and may be described formulaically as follows:

$$\frac{D_b + \sqrt{(D_b^2 - D_s^2)}}{2V_b} < 1/f$$

where:

$D_b$ is the diameter of the sphere or ball, $D_s$ is the diameter of the surface of the valve seat where it contacts and seals with the sealing mechanism, $V_b$ is the velocity of sound in the sphere or ball, and f is the frequency of the ultrasonic signal emitted from the ultrasonic horn.

Creation of this unbalanced force causes the sealing mechanism 28 to unseat from the valve seat 30 allowing liquid flow to develop around the sealing mechanism. For example, should the sealing mechanism comprise a spherical steel ball, the velocity of sound through the ball would be approximately 5,000 m/s whereas the velocity of sound through the liquid would be approximately 1,300 m/s for kerosene. As stated earlier, "□" is the frequency of the ultrasonic signal emitted from the horn, for example, approximately 20 kHz to about 40 kHz.

By incorporating an ultrasonic horn 60 within the valve body 20 itself, a valve body capable of remaining stationary with respect to an external environment is possible. That is, the valve body itself may be stabilized against movement although the horn contained within the valve body is allowed to resonate freely. Of course, those skilled in the art would understand that the horn 60 would be mounted at its node 52 to a suitable surface within the valve body 20 so that the tip was free to resonate within the passage 26. As such, the passage 26 may include a chamber 64 within which the horn tip 62 is situated. This configuration would be capable of minimizing, if not eliminating any transference of movement between the horn and the valve body. Consequently, the valve body 20 may be rigidly attached to an external apparatus or piping at either or both of the inlet 22 and the outlet 24.

Throughout the specification thus far, the sealing mechanism 28 has been referred to as a spherical shape or ball but as described supra, the sealing mechanism may be configured into numerous other shapes as well. Regardless, each configuration is made to match with the valve seat 30 with which it is associated. As discussed above, a coating 32 may also be provided to enhance the sealing between the sealing mechanism 28 and the valve seat 44. The important point in any of the embodiments disclosed herein is that upon application of ultrasonic energy to the system, the sealing mechanism 28 is moved or otherwise unseated from the valve seat 30.

Another advantage of a valve mechanism in accordance with the present invention is that such a mechanism does not rely upon gravity to operate, that is, a valve in accordance with the present invention does not require gravity to create either the restoring force or the initial inertial force necessary to operate the valve. Consequently, a valve in accordance with the present invention may be oriented in any direction without impacting its functionality. Since the sealing mechanism 28 is seated to the valve seat 30 by application of a high pressure liquid, it is expected that some temporary flow might occur between cessation of the application of ultrasonic energy and that point in time when the sealing mechanism fully seats with the valve seat. This temporary flow is the drool or drip of the valve closure and is minimized by the time duration between discontinuation of the ultrasonic energy and movement of the valve closure, e.g., ball to the seat. The distance the ball moves away from the valve seat and the viscosity of the liquid and static pressure of the liquid will determine the amount of temporary flow that will occur.

While various patents have been incorporated herein by reference, to the extent there is any inconsistency between incorporated material and that of the written specification, the written specification shall control. In addition, while the invention has been described in detail with respect to specific embodiments thereof, it will be apparent to those skilled in the art that various alterations, modifications and other changes may be made to the invention without departing from the spirit and scope of the present invention. It is therefore intended that the claims cover all such modifications, alterations and other changes encompassed by the appended claims.

We claim:

1. An ultrasonically operated valve comprising:

a valve body having an inlet, an outlet, a passage in communication with the inlet and outlet, and a valve seat proximal to the outlet;

a valve sealing mechanism disposed within the passage adapted to be received by the valve seat and seal the passage from an external environment upon introduction of a pressurized liquid into the passage;

a source of ultrasonic energy for excitation of the pressurized liquid; the source of energy vibrating the valve sealing mechanism away from the valve seat thereby enabling liquid to exit the passage through the outlet, the source of ultrasonic energy being at least partially contained within the passage, the source of ultrasonic energy further comprising a tip corresponding to an antinode of the source of ultrasonic energy, the tip spaced a distance from the valve sealing mechanism.

2. The valve of claim 1 wherein the valve body and the valve sealing mechanism acoustically resonate at different frequencies.

3. The valve of claim 1 comprising a resilient surface coating on any of the valve sealing mechanism and the valve seat.

4. The valve of claim 1 wherein the valve sealing mechanism comprises at least two discrete materials.

5. The valve of claim 1 wherein the distance ranges from about 1.5 diameters to about 20 diameters.

6. The valve of claim 1 wherein the material properties of the valve sealing mechanism are selected such that ultrasonic energy from the source is acoustically transmitted through the valve sealing mechanism more rapidly than the energy is transmitted through the pressurized liquid.

7. The valve of claim 1 wherein the valve sealing mechanism is conical in shape.

8. A valve for controlling the flow of a pressurized liquid comprising:

a valve seat, a sealing mechanism interacting with the valve seat, a resonant body having a tip located at an antinodal plane of the resonant body, the tip directed at the sealing mechanism an ultrasonic energy source coupled to the resonant body, and a pressurized liquid;

wherein the pressurized liquid serves to seat the sealing mechanism against the valve seat, preventing flow of the pressurized liquid; and wherein the ultrasonic energy source vibrates the resonant body and imparts acoustical energy into both the pressurized liquid and the sealing mechanism, creating an unbalanced pressure pulse on the sealing mechanism, unseating the sealing mechanism from the seat, enabling flow of the pressurized liquid.

9. The valve of claim 8 comprising a valve body, the resonant body being at least partially contained within the valve body and affixed to the valve body at a nodal plane of the resonant body.

10. The valve of claim 8 comprising a liquid inlet and a liquid outlet, at least one of which is stationary and non-moving with respect to an environment external to the valve.

11. The valve of claim 8 wherein the valve seat and sealing mechanism are situated within an internal passage provided in the resonant body, the internal passage further comprising an inlet and an outlet, wherein activation of the ultrasonic energy source vibrates the resonant body unseating the sealing mechanism from the seat, enabling flow of the pressurized liquid from the inlet, through the internal passage, and exiting the valve via the outlet.

12. The valve of claim 8 wherein the valve sealing mechanism is spherical in shape.

13. The valve of claim 8 wherein the valve sealing mechanism is conical in shape.

14. The valve of claim 8 wherein the valve sealing mechanism comprises at least two discrete materials.

15. The valve of claim 8 comprising a resilient surface coating on any of the valve sealing mechanism and the valve seat.

* * * * *